United States Patent [19]

Yoshimi

[11] Patent Number: 4,641,941

[45] Date of Patent: Feb. 10, 1987

[54] TREATMENT TANK IN PHOTOSENSITIVE MATERIAL PROCESSING SYSTEM INCLUDING A PLURALITY OF OVERFLOW DEVICES

[75] Inventor: Yasuhito Yoshimi, Kyoto, Japan

[73] Assignee: Dainippon Screen Mfg. Co., Ltd., Kyoto, Japan

[21] Appl. No.: 760,327

[22] Filed: Jul. 29, 1985

[30] Foreign Application Priority Data

Aug. 2, 1984 [JP] Japan ..... 59-118414[U]

[51] Int. Cl.[4] ..... G03D 3/02

[52] U.S. Cl. ..... 354/324; 354/331

[58] Field of Search ..... 354/320, 321, 322, 324, 354/328, 331, 335, 337

[56] References Cited

U.S. PATENT DOCUMENTS 3,626,832 12/1971 Kappeler ..... 354/324
4,252,429 2/1981 Hope et al. ..... 354/328
4,269,209 5/1981 Peterson ..... 354/331
4,312,586 1/1982 Ohtani ..... 354/324

OTHER PUBLICATIONS

Kimmel et al, "Research Disclosure 21116", Nov. 1981, pp. 411 and 412, Eastman Kodak.

*Primary Examiner*—A. A. Mathews
*Attorney, Agent, or Firm*—Lackenbach Siegel Marzullo & Aronson

[57] ABSTRACT

A treatment tank in photosensitive material processing system or the like is equipped with a plurality of overflow devices and a partition member for separating liquid surface part extending at least to one overflow device from the other, below the liquid surface with at least one opening or gap allowing the treatment liquid to flow from side of the partition, and with the partition member solution in the middle and deep region of the tank passes through the opening or gap to flow over insoluble solids being suspended therein.

5 Claims, 4 Drawing Figures

TREATMENT TANK IN PHOTOSENSITIVE MATERIAL PROCESSING SYSTEM INCLUDING A PLURALITY OF OVERFLOW DEVICES

This invention relates to a treatment tank in a photosensitive material processing system, such as tanks for development fixing or washing.

Known tank for processing photosensitive material is fed with a treatment solution or washing water, as supplement, and the resulting surplus flows over through an outlet, with the liquid level remaining constant, in order to restore the treatment liquid from exhausted and/or contaminated state. Such a treatment tank is exemplified in Japanese Patent Laid-Open No. 153944/1981.

In general, a treatment tank contains, in addition treatment liquid, insoluble solids as of silver, gelatin, fur, dirt, etc., resulting from processing of photosensitive material.

Out of these insoluble solids, some rising to the liquid surface flow over from the tank, and those suspending in the treatment solution almost remains stay and concentrated in the tank. The thus concentrated solids are problematic in having the incidence not only to deposit to the photosensitive material, with consequent dirty film, but also to make the inner surface of the tank dirty.

The invention provides, as means for solving these problems, a treatment tank equipped with a plurality of overflow devices, and a partition member for separating a liquid surface part extending to at least one overflow device from the other and provided, below the liquid surface with at least one opening or gap allowing treatment liquid to flow from side of the partition member to the other side.

The partition member takes the effect that solution in the middle and deep region of the tank, passes through the opening or gap and then flows over by means of the overflow devices while carrying insoluble solids suspended therein. Thus the suspended solids are expelled from the treatment tank.

The above and other objects, features and advantages of the present invention will become apparent from the following description and the appended claims, taken in conjunction with the accompanying drawings.

Figure 1:
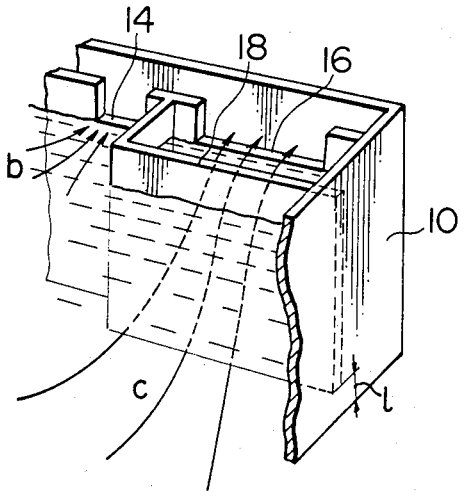
FIG. 1 is a perspective view of the essential parts of an embodiment in accordance with the invention.
Figure 2:
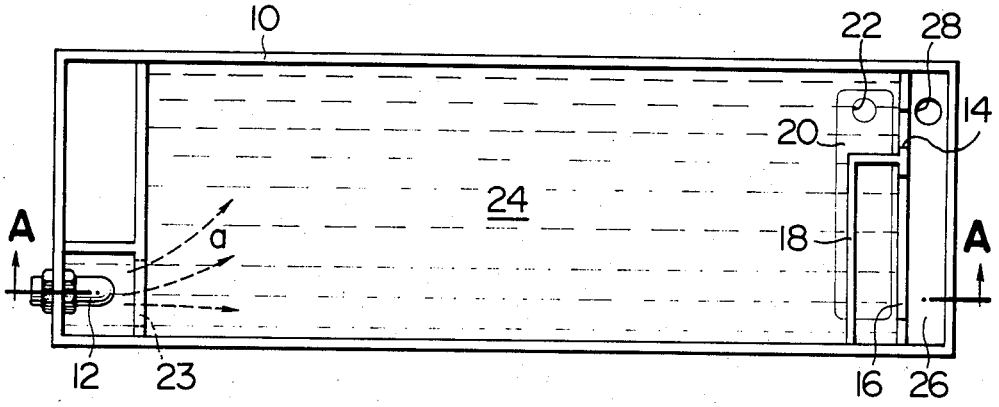
FIG. 2 is a plan view of the same.
Figure 3:
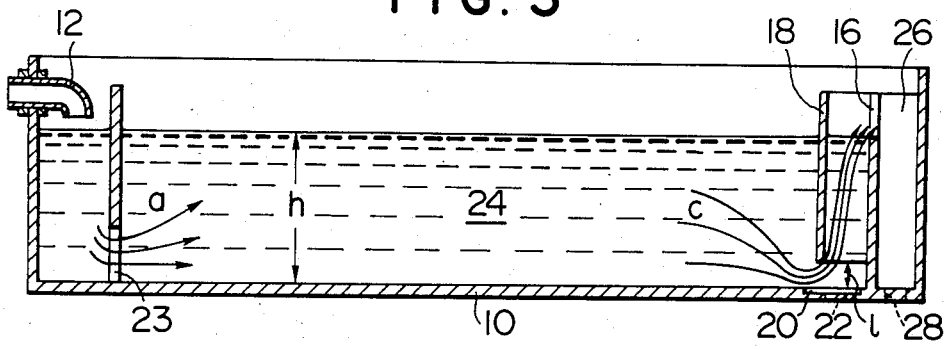
FIG. 3 is a cross-sectional view taken along line A—A of FIG. 2.

Referring to FIGS. 1 to 3, a reference character 10 designates a washing tank filled with water to a water level (h), in which photosensitive material is washed while being conveyed in washing water by means of a roller conveyer (not illustrated) or the like.

Reference characters indicates as follows: 12 a washing water feed nozzle, 14 a first overflow notch and 16 a second overflow notch. There is a partition member 18 surrounding the second overflow notch 16 and disposed so as to create a gap between its lower end and the bottom of the washing tank 10 through which washing water passes.

Another reference character 20 designates a recess provided on the bottom of the washing tank 10 and receiving sediments to be recovered. An exit, designated at reference character 22, for completely expelling washing water from the washing tank 10 at repair, cleaning, etc. It is closed normally and opened occasionally, for instance at cleaning, etc.

Washing water is fed through the nozzle 12, followed by an opening 23 into the inside 24 of the washing tank 10, as indicated by arrows (a), and flow over the first notch 14, and the second notch 16, thus the water level being kept constant.

Then, out of washing water flowing through the pool 24 of the washing tank, some composing the relatively superficial stream layer overflow at the notch 14, as arrows (b) indicate. On the other hand, washing water of the middle and deep stream layers, as shown by arrows (c) is forced to pass through the gap, and then overflows at the notch 16.

Washing water overflowed at both notches enters a confluence chamber 26 and the drained through drain bore 28 in the bottom of it.

How solids stayed in the washing tank are purged will be described hereinafter:

Associated with washing of photosensitive material, some of insoluble solids released in the washing water rise to the water surface and others are suspended in the washing water.

As stated above, washing water fed through the nozzle 12, branches into superficial stream and relatively deep stream. In solids rising to the water surface leaves through the notch 14, as arrows (b) indicate, whereas insoluble solids suspended in the solution is carried by the relatively deep stream and purged through the notch device 16, as shown by arrows (c).

Besides, a part of solids released in the washing water and having relatively greater specific gravity is deposited at the bottom of the washing water pool 24.

The thus-formed sediment on the bottom are forced to move by the stream passing through the opening 23 and the stream along the bottom to the recess 20 to get together there, which are removed through the exit 23 at cleaning of the washing tank.

For the purpose of facilitating the above-mentioned recovery of insoluble solids having relatively great specific gravity, the bottom of the washing tank 10 may be constructed to somewhat slope down to the recess 20.

In stead of both notches 14, 16 flushed with each other provided in the above-stated example, for instance, when the amount of washing water is relatively large, the notches 14, 16 can somewhat different in height from each other depending on the ratio between respective widths.

Figure 4:
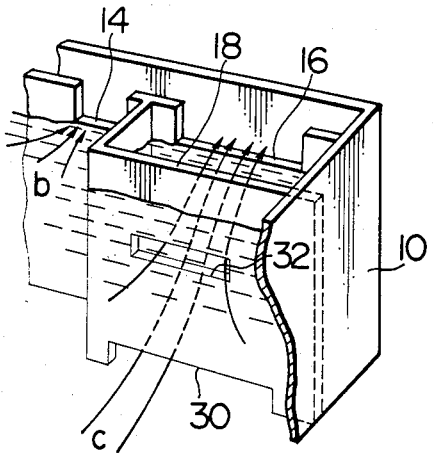
FIG. 4 is a perspective view of the essential parts of an alternative embodiment in accordance with the invention.

FIG. 4 shows a perspective view of essential parts of a modified washing tank according to the invention, in which the same parts as those in FIG. 1 are designated identically, with omission of their description.

As compared with the first example in which the gap 1 is created between the bottom of the washing tank 10 and the lower end of the partition member 18, there is provided, for the place of the gap, with a gate 30 through which washing water passes at the lower end portion of the partition member 18, with consequent similar effect to that in Example 1.

In FIG. 4, a reference character 32 designates a bore, the second device for permitting treatment liquid to pass there-through. It is effective for facilitating purge of insoluble solids suspended below the superficial layer and above the vicinity to near to the tank bottom. Particularly better for a processing tank having relatively deep or large height (h).

These examples are of washing tank in accordance with the invention. The same effects as stated in these examples are taken for other processing tanks such as development tank or fixing tank.

Furthermore, as substitute overflow devices for the notches 14, 16 in the above-described examples, it is matter of course to use overflow tubes as in conventional way.

Treatment tanks according to the invention, which are constructed as above-described, have the following advantages:

Permitting insoluble solids to be readily purged from all over the treatment tank as well as from the superficial layer of treatment liquid, with effect to prevent photosensitive material and the inner tank surface from becoming dirty.

Secondly, as associated with the construction according to the invention, taking in the effects of the partition member to enhance whole circulation of treatment liquid to a satisfactory extent and to permit insoluble solids deposited at the tank bottom to readily get together towards the overflow side, with consequent easy cleaning of the processing tank.

In addition, the use of notches as overflow device contributes to more rapid removal of insoluble solids from a wider region.

Having now fully described the invention, it will be apparent to one of ordinary skill in the art that many changes and modifications can be made thereto without departing from the spirit or scope of the invention as set forth herein.

What is claimed is:

1. A treatment tank for use in a photosensitive material processing system of the type in which treatment liquid is fed into said treatment tank through a liquid feeding device, and the liquid level of said tank is kept constant by way of overflow, comprising, in said treatment tank, a plurality of overflow devices, and a partition member for a separating the part of the surface of the treatment liquid which extends to at least one of said overflow devices from the part of the surface of the treatment liquid which extends to the remaining overflow devices, said partition member allowing treatment liquid to flow from one side thereof to the other side thereof below the liquid surface.

2. A treatment tank as defined in claim 1, wherein said partition member is spaced from the bottom of said treatment tank to create a gap through which treatment liquid is allowed to flow from one side of said partition member to the other side thereof below the liquid surface.

3. A treatment tank as defined in claim 1, wherein said partition member is provided, below the surface of the treatment liquid, with at least one opening therein through which treatment fluid is allowed to flow from one side of said partition member to the other side thereof.

4. A treatment tank as defined in any of claims 1 through 3, wherein the bottom of said treatment tank is provided with a sediment collecting recess near one of said overflow devices, and a normally closed drain valve is installed in said recess.

5. A treatment tank as defined in claim 4, wherein the bottom of said tank is sloped toward said recess.

* * * * *